US005238399A

United States Patent [19]

Long

[11] Patent Number: 5,238,399

[45] Date of Patent: Aug. 24, 1993

[54] MATERIAL TREATING APPARATUS

[75] Inventor: David H. Long, Springfield, Ohio

[73] Assignee: Jet-Pro Company, Inc., Atchison, Kans.

[21] Appl. No.: 831,426

[22] Filed: Feb. 5, 1992

[51] Int. Cl.[5] ..... F27B 9/28

[52] U.S. Cl. ..... 432/59; 432/8; 432/143; 432/152

[58] Field of Search ..... 432/58, 59, 8, 143, 432/144, 152

[56] References Cited

U.S. PATENT DOCUMENTS

| | | | |
|---|---|---|---|
| 3,550,920 | 12/1970 | Geipel | 432/59 |
| 4,217,090 | 8/1980 | Whike et al. | 432/8 |
| 4,588,378 | 5/1986 | Yamamoto et al. | 432/152 |
| 4,789,332 | 12/1988 | Ramsey et al. | 432/59 |
| 4,792,302 | 12/1988 | Baker et al. | 432/59 |
| 4,802,843 | 2/1989 | Chilva | 432/8 |
| 4,944,098 | 7/1990 | Hella et al. | 432/59 |
| 5,131,841 | 7/1992 | Smith et al. | 432/152 |

*Primary Examiner*—Henry C. Yuen
*Attorney, Agent, or Firm*—Robert E. Stebens

[57] ABSTRACT

A material treating apparatus having a treating chamber through which material is continuously displaced over an elongated, horizontally disposed bedplate. The bedplate is formed with a large number of small apertures distributed over the plate and permitting a gaseous treating fluid to flow upwardly through the bedplate and the overlying material to effect its treatment. A distribution chamber for the gaseous fluid underlies and extends the length of the bedplate and connects at one longitudinal end with a source of the fluid. This source induces the gaseous fluid to flow into and then longitudinally through the distribution chamber ultimately exiting through the apertures of the bedplate. A flow control plate is positioned in the distribution chamber adjacent the end through which the gaseous fluid enters. The plate extends horizontally across the chamber and is pivotable about a horizontal axis to a selected angular position to cause the gaseous fluid to flow along a desired path through the distribution chamber.

8 Claims, 4 Drawing Sheets

MATERIAL TREATING APPARATUS

FIELD OF THE INVENTION

This invention relates in general to apparatus for treating of particulate material such as agricultural grains. It relates more particularly to apparatus designed to treat the material as it is transported over a fluidizing bedplate by subjecting it to heated gaseous treating fluids primarily consisting of heated air. This invention is specifically related to those portions of such treating apparatus constructed to supply the gaseous treating fluid and effecting control over direction of flow of the fluid for optimum efficiency and effectivity in treatment of the material.

BACKGROUND OF THE INVENTION

This invention, relating to improvements in fluidized bed apparatus, has particular utility in the field of treating agricultural grain products such as soybeans, corn and other cereal grains to condition those grains for more efficient usage as food products for agricultural purposes, specifically, feeding of cattle and hogs. By subjecting such grains to a treatment process wherein they are heated to elevated temperatures of a predetermined magnitude for a specified length of time, the nutrient qualities are significantly improved resulting in increased efficiency with respect to digestion into the systems of the livestock which are fed such materials.

Exemplary of apparatus for effecting heat treatment of agricultural grain products that have been devised and heretofore utilized is a fluidized bed-type apparatus such as that which is disclosed in U.S. Pat. No. 4,419,834 issued to John F. Scott on Dec. 13, 1983. That patent discloses an apparatus having a treatment chamber provided with a perforated bedplate at its bottom and across which the grain products are caused to traverse while concurrently effecting a flow of heated air through the bedplate.

Apparatus of this general type frequently is of a dimension having a bedplate of the order of two to three feet wide and ten to fifteen feet in length. The problem that is encountered in obtaining the most advantageous utilization of the apparatus is effecting a suitable flow of the heated gaseous fluid through the perforated bedplate and the particulate material which is traversing that bedplate. It is important that the flow of the gaseous treating fluid be effectively controlled and distributed throughout the entire extent of the bedplate taking into consideration the desirability of having the treating fluid at the highest temperature entering the material at selected areas along the longitudinal length of the treating chamber. Not all grains respond in exactly the same manner to such a treatment process and care must be exercised in effecting the passage of the heated air through the material to avoid burning the material or otherwise failing to effect a full and appropriate treatment of the material.

SUMMARY OF THE INVENTION

In accordance with this invention, a particulate material treating apparatus of the fluidized bed-type is provided having a gaseous treating fluid supply that is selectively operable to effect directional control of the flow of the gaseous fluid into and through the treating apparatus. The treating apparatus, in general, comprises a treating chamber of elongated configuration provided with a perforated bedplate and has a treating fluid supply coupled with the treating chamber to effect a flow of treating fluid through the bedplate and the particulate material that is being transported over that plate. This fluid supply includes an elongated distribution chamber disposed in underlying relationship to the bedplate, a blower for inducing a flow of ambient air into the distribution chamber and a heating unit interposed in the flowpath for elevating the temperature of the air introduced into the chamber. The configuration of the distribution chamber is of elongated construction that is of a dimension commensurate with the treating chamber and particularly its bedplate. The blower and heating unit are disposed at one end which is designated as the entrance end to the treating apparatus. The air, after being heated by the heating unit, flows longitudinally through the distribution chamber and upwardly through the perforations in the bedplate and then passes through the particulate material that is traversing over the top of the bedplate to effect the treatment thereof.

To enable control over the path of the heated air, the supply mechanism, in accordance with this invention, includes a flow controlling plate disposed in preceding relationship to the heating unit. This control plate comprises a planar sheet that is mounted to extend transversely across the flowpath and is supported by a pivot mechanism enabling the plate to be disposed at a selected angular position about a horizontal pivot axis extending transversely across the flowpath that results in the air flowing into and through the distribution chamber to be initially directed toward selected areas along the bedplate for optimum treatment of the material. Heated air, in general is caused to flow longitudinally through the chamber where it is distributed, but its distribution as to the region where the hottest air passes through the bedplate is effectively controlled by the angular position of the control plate. Thus, by appropriate positioning of the control plate, the air in accordance with its temperature can be concentrated at a desired region on the bedplate for optimum treatment of the specific material being processed.

The air is caused to flow into the distribution chamber at its entrance end in an essentially coaxial relationship to the longitudinal axis of the distribution chamber. The control plate is supported at a vertical elevation which is a distance below the central axis. This location of the control plate better enables it to effect the desired control over the flowpath of the air as it exits from the heating unit and flows through the distribution chamber. By appropriate angular disposition of the plate, it is thus possible to cause the air to initially flow along a path that results in its intersecting with the bedplate primarily in a predetermined area displaced a selected distance downstream with respect to the entrance end. Alternative positioning of the control plate at different angles results in the flowpath being altered to have a greater proportion of the air flow along a path which will tend to take it toward the discharge end of the bedplate, and thus, result in higher temperature air acting on the material in regions more remote to the entrance end than in the initially described case where the air is concentrated along a flowpath that intersects the bedplate in a region more closely adjacent the entrance end. Thus, by appropriate angular adjustment of the control plate, it is possible to adjust the flowpath to cause the heated air to intersect and flow through the bedplate in a manner that is deemed optimum for treatment of any specific material as determined in accordance with where the higher temperature air should be caused to flow through the material during the course of its transit through the treatment chamber and over the bedplate.

These and other objects and advantages of this invention will be readily apparent from the following detailed description of an illustrative embodiment thereof and the accompanying drawings.

DESCRIPTION OF THE DRAWING FIGURES

DESCRIPTION OF THE ILLUSTRATIVE EMBODIMENT

Figure 1:
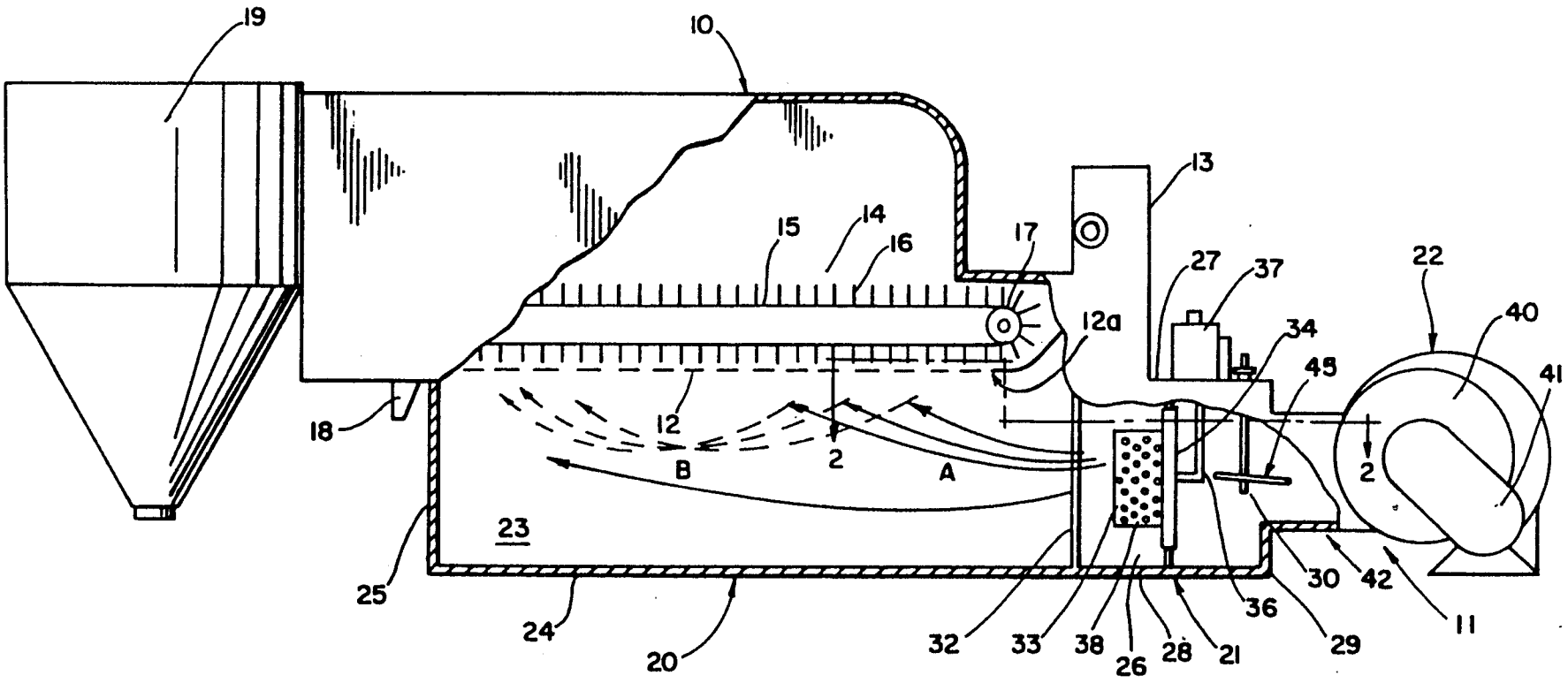
FIG. 1 is a diagrammatic side elevational view of a particulate material treating apparatus embodying this invention with portions of its sidewall thereof broken away for clarity of illustration of components.
Figure 2:
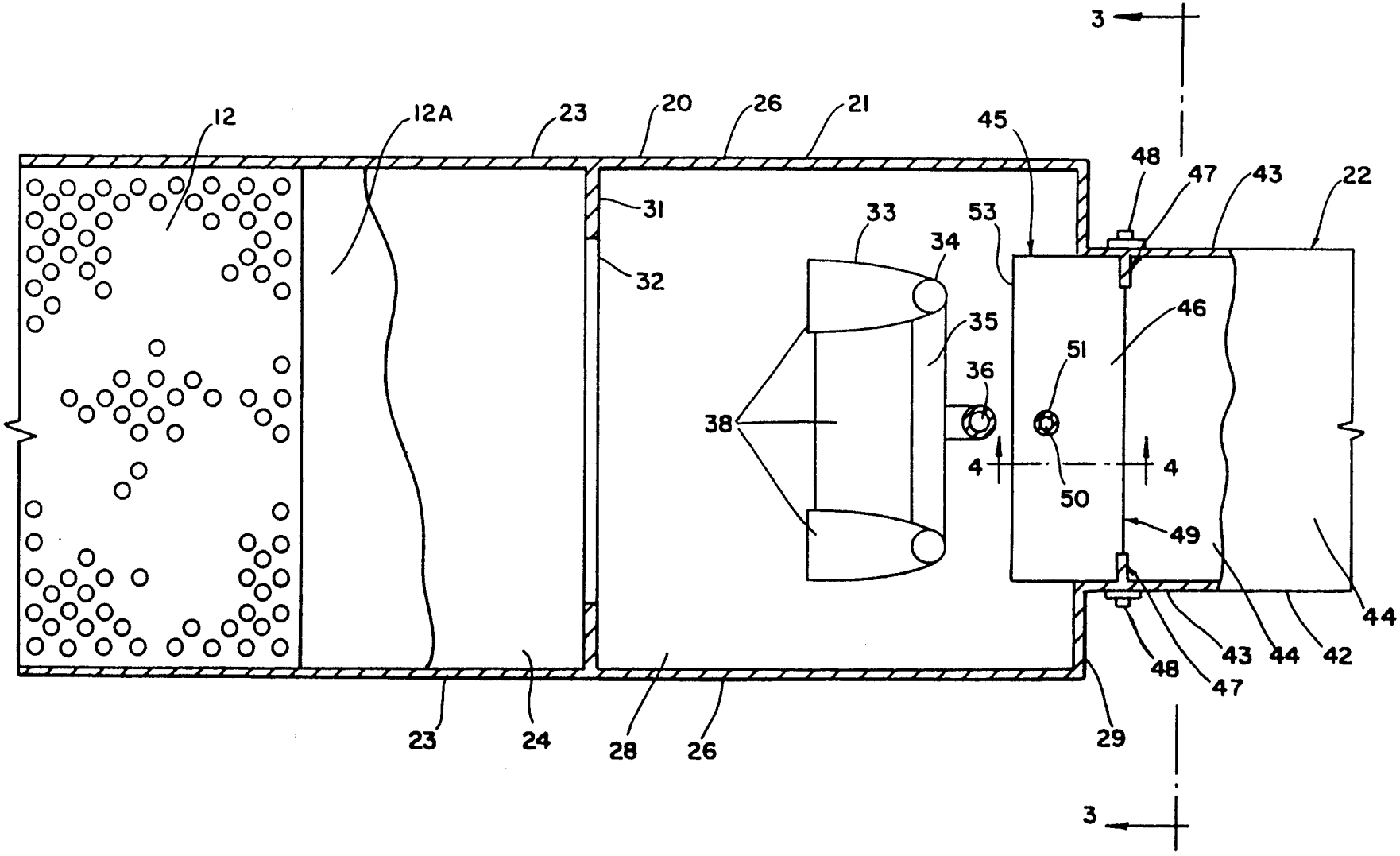
FIG. 2 is a fragmentary sectional view on an enlarged scale taken along line 2—2 of FIG. 1.
Figure 3:
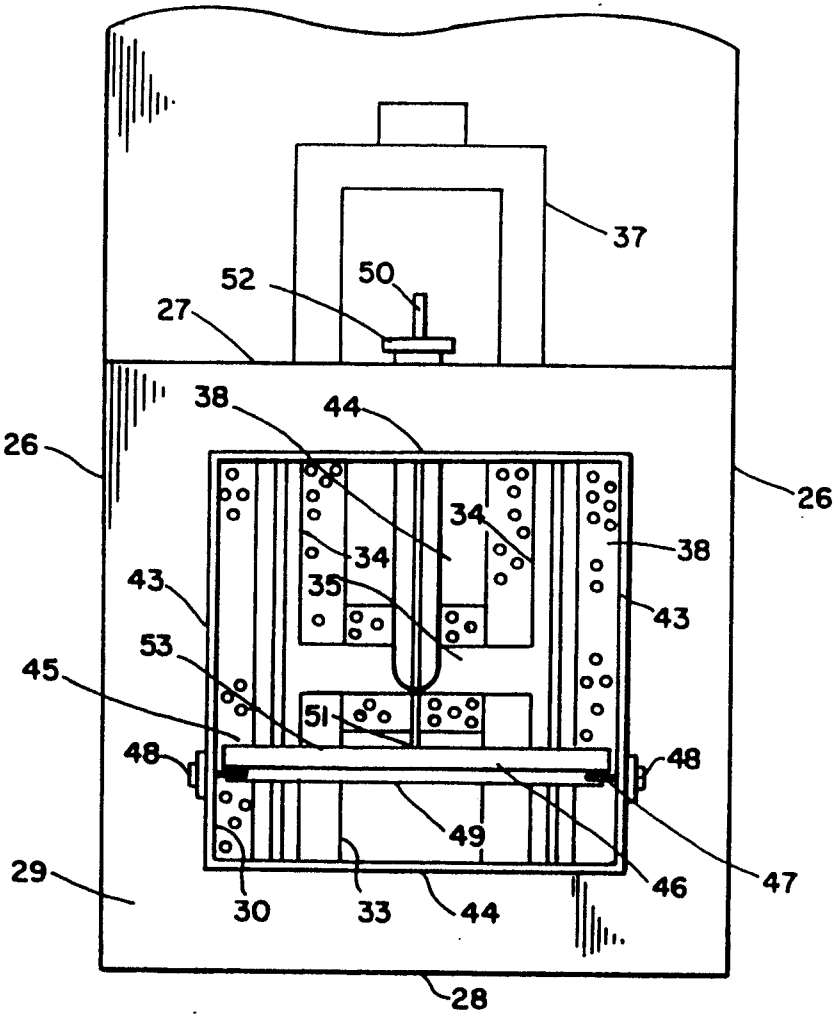
FIG. 3 is a fragmentary sectional view taken along line 3—3 of FIG. 2.

Having reference to the drawings, a treating apparatus embodying this invention is illustrated diagrammatically in FIG. 1 in substantially its entirety to provide a background for the particular improvements of this invention. This apparatus includes a treating chamber 10 that is of elongated configuration and having a generally rectangular cross-section and is positioned vertically above a gaseous treating fluid supply 11. The treating chamber 10 is provided with a bedplate 12 which forms its bottom wall and extends from an inlet end located at the right side of FIG. 1 and terminating at a discharge end located at the left side of FIG. 1. A particulate material feeder 13 is positioned at the inlet end of the treating chamber. It is designed to receive the material at an open top and to then regulate the outflow of the material from a bottom end (not shown) into the interior of the treating chamber at its inlet end and is operable to be adjusted to effect control over the rate of inflow of the material. A drag-type conveyor 14 extends longitudinally of the treating chamber in overlying relationship to the bedplate 12. This conveyor 14 comprises an endless chain 15 having a plurality of conveyor flights 16 secured thereto at uniformly spaced intervals with the chain being trained around a pair of sprocket wheels 17 for revolution in a vertically disposed plane. One of these sprocket wheels 17 such as the one located at the inlet end is coupled with a mechanical drive mechanism. Components such as the drive mechanism and other mechanical structures are not shown or otherwise described as their construction and function is well-known to those familiar with this art. The treated and processed particulate material is removed from the treating chamber 10 at the discharge end through a discharge mechanism 18 where it is deposited into a suitable receptacle or other device for its removal and transport from the treating apparatus.

The gaseous fluid which is primarily heated air is removed from the treating chamber at the discharge end through a device which functions to separate the air from the solid debris components that may also be entrained in that fluid stream. This debris separating device is shown in the FIG. 1 diagram as being a structure known as a cyclone separator. Its function and operation, as well as its construction, is also well-known to those familiar with this art and the details are not further illustrated or described.

The components forming the gaseous treating fluid supply 11 include an elongated distribution chamber 20, a heating unit 21 and a fan 22 which are disposed in axially aligned relationship. The distribution chamber 20 is of a rectangular cross-section configuration and of a length that is substantially equal to the length of the bedplate 12 with that bedplate also forming the top of the distribution chamber. The distribution chamber includes longitudinal sidewalls 23 interconnected by a bottom wall 24 and closed at the end adjacent the discharge end of the apparatus by an endwall 25. In an illustrative embodiment of the apparatus which has a bedplate approximately twelve feet in length and 30 inches in width, the distribution chamber also has a width substantially equal to that of the bedplate and a vertical dimension that is also of the order of 30 inches resulting in a square cross-section distribution chamber.

The heating unit 21 comprises a chamber of relatively short length as compared to the distribution chamber 20 and is disposed in flow-preceding relationship to the distribution chamber. It is formed with vertical sidewalls 26 and has top and bottom walls 27 and 28. An endplate 29 is disposed at the entrance end to the heating unit chamber and is formed with a central square aperture 30 having a dimension of approximately 22 inches on each edge and essentially approximates the size of the discharge of the fan 22. Positioned at the opposite end of the heating unit chamber is a baffle plate 31 that is also formed with a central square aperture 32 with edge dimensions of the order of 26 inches. The length of the heating unit chamber is of the order of 30 inches and a burner 33 designed to utilize petroleum fuel products is centrally positioned in the chamber. This burner is of a commercially available design that is of an H-shape configuration having two vertical burner pipes 34 that are disposed in spaced relationship and are interconnected by a horizontal burner pipe 35 at approximately their vertical midpoint. A fuel supply pipe 36 connects centrally with the horizontal pipe 35 and it in turn connects with a fuel control assembly 37 that is disposed on the top of the heating unit chamber. The control assembly is adapted to connect with a source of suitable petroleum fuel such as either natural gas or liquified propane. The mechanisms of the control assembly are not further illustrated or described as such a device is commercially available and known to those familiar with this particular art. Also incorporated with the burner is an air shield 38 forming a heat exchanger having pairs of divergent sidewalls carried by the burner pipes and projecting in downstream relationship to the burner nozzles. The air shield is formed with a number of apertures through which the air entering into the heating unit chamber will flow into association with the fuel gas discharged from the nozzles on the burner pipes and when ignited will generate a flame for heating of the air passing through the chamber.

A flow of air through the heating unit chamber and into the distribution chamber is effected by the fan 22 which, in the illustrative embodiment, is of a centrifugal type. Such a fan includes a cylindrical rotor revolved within a housing 40 by means of an electric motor drive mechanism 41. The fan housing 40 terminates in a discharge end portion 42 that is coupled to the entrance end plate 29 of the heating unit chamber. The fan discharge end portion is also of a rectangular cross-section having vertical sidewall panels 43 and horizontal top and bottom panels 44, and is of essentially the same dimension as the central aperture 30 of the entrance endplate.

In accordance with this invention, a flowpath control mechanism 45 is provided to enable the operator to effect control over the direction of flow of the heated gas exiting from the heating unit and its traversing of the distribution chamber and passage through the bedplate 12. This control mechanism 45 includes a control plate 46 which is positioned at the entrance end to the heating unit chamber in preceding relationship to the burner 33. This plate 46, which is of rectangular shape, is supported for pivotal movement about a horizontal axis extending transversely across the longitudinal axis of the flowpath of gases through the heating unit 21 and distribution chamber 20. A pair of trunnions 47 extend longitudinally outward from the plate at each respective end of the control plate and are journalled in a respective bearing 48. Each of those bearings is carried by a respective one of the sidewall panels 43 of the fan housing's discharge end portion 42. These trunnions 47 are secured to an edge 49 of the control plate and thus retain that edge at a fixed location extending transversely across the flowpath of the air.

Selective positioning of the plate 46 and its maintenance in a desired angular position is effected by a control rod 50 that is secured to the plate by a pivot connection 51 capable of accommodating the angular movement of the plate. The rod 50 extends vertically upward from the plate and projects outwardly above the top wall 27 of the heating unit chamber. An adjustment device 52 is assembled by a screw-threaded interconnection with the upper end portion of the rod 50 and is operable in cooperation with the top wall 27 of the heating unit 21 with which it is retained to effect vertical displacement of the rod to a desired position whereby the angular position of the plate may be adjusted and maintained. The control plate 46 is of a length substantially equal to the width of the aperture 30 in the entrance endplate 29 and is of a width of the order of six inches. Its positioning with respect to the burner is that the downstream free edge 53 of the plate is about six inches away from the burner pipes 34 and 35 with its pivoted edge 49 being supported at a distance of about four inches above the bottom edge of the aperture in the entrance endplate. By appropriate adjustment of the control rod 50, the plate 46 may thus be displaced between respective angular positions that, by way of example, and not limitation, are indicated by broken lines and maintained in a selected position.

Functioning of the control mechanism 45 is diagrammatically illustrated in FIG. 1. A fan of typical size for use with the apparatus of the illustrative dimensions has a capacity of inducing a flow of the order of 12,000 CFM. This flow of air in an apparatus which is either not provided with the inventive control mechanism 45, or has the control plate 46 thereof disposed in a horizontal plane, will tend to turn upwardly from an initial horizontal path as it exits from the heating unit 21 to pass through the apertures of the bedplate 12 in the region closely adjacent to the entrance end in immediately following relationship to the bedplate extension. There will be certain proportions of the air that will flow axially through the distribution chamber 20 to a greater distance before tending to flow upwardly through the bedplate. Air that flows a greater distance axially through the distribution chamber will tend to cool and thus be at a relatively lower temperature when it exits through the bedplate apertures. In this neutral or non-controlled flow condition with the control plate 46 horizontal, the heated air will tend to flow in a manner such that the greater proportion of the air at higher temperatures will pass through the bedplate at a more central longitudinally disposed region. This is not necessarily an optimum treating condition for some materials as it is advantageous in certain cases to have a greater proportion of higher temperature air pass through the apertures of the bedplate at a point more closely adjacent its entrance end. For some materials and for other processing situations, it is advantageous to cause the air to flow in a path where a greater proportion of higher temperature air will tend to pass through the bedplate at locations that are further downstream.

Figure 4:
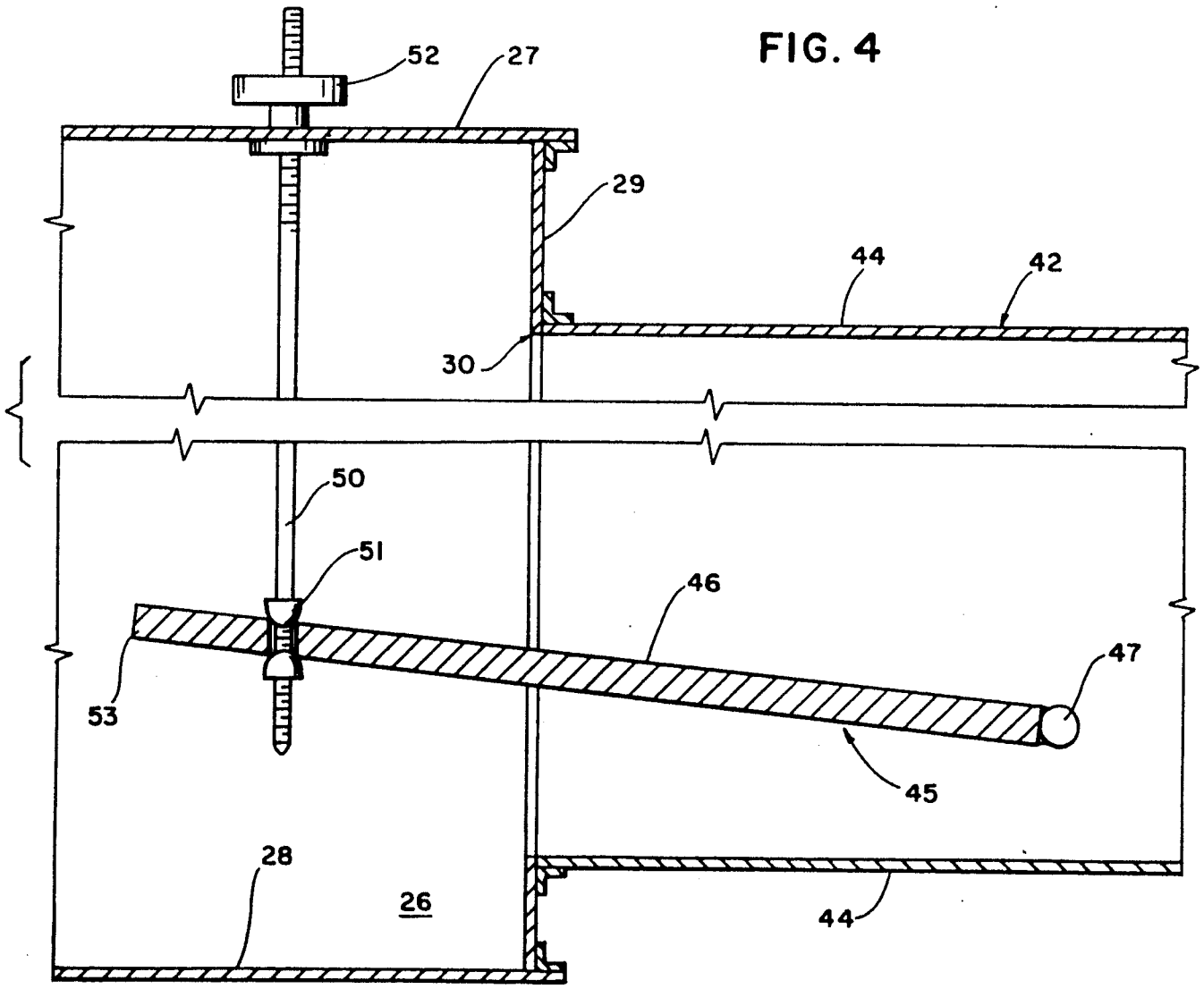
FIG. 4 is a fragmentary sectional view taken along line 4—4 of FIG. 2.

With the control mechanism 45 of this invention, it is possible to effect control over the path of movement of the heated air in a manner which enables the operator to effect a change in the flowpath from the neutral flow condition. For example, by pivoting the control plate 46 to an upwardly angled position as shown in FIG. 4, a greater proportion of the air at higher temperatures can be caused to flow along a path indicated by the arrows designated by the letters A to initially engage the bedplate 12 at locations more closely adjacent the entrance end. With a greater proportion of the higher temperature air thus passing through the apertures at the entrance end of the bedplate, the particulate material will be more rapidly elevated in temperature as it enters the treating chamber. Air that does not pass through the apertures at the entrance end of the bedplate will be deflected and traverse generally along a path diagrammatically illustrated by the broken lines designated by the letter B. It will be understood that air will also be flowing along paths that are initially adjacent the bottom of the distribution chamber and then tend to turn upwardly and pass through apertures of the bedplate at locations more closely adjacent the discharge end.

By placing the control plate 46 in a downwardly inclined position, a greater proportion of the air at higher temperatures can be caused to flow longitudinally through the distribution chamber to points that are more closely adjacent the discharge end. This results in a greater heating effect being applied to the material at locations that are more remote to the entrance end of the bedplate and this produces a different processing effect on the material.

The capability of directing the airflow to specific regions is particularly advantageous with respect to the bedplate extension **12*a* which is not formed with apertures. If high temperature air is permitted to be incident to the extension, it may become extremely hot and tend to overheat the material that is passing over the extension resulting in adverse processing of the layer of material that is immediately adjacent the upper surface of the extension. By appropriate angular positioning of the control plate 46, the air can be directed with a relatively high degree of precision to minimize the heating of the extension 12*a*, but still cause a desired proportion of the air to be initially incident to the apertured bedplate 12 at a region that is close to the entrance end of the treatment chamber 10**.

While the treatment apparatus provided with airflow control mechanism of this invention is described as being utilized with particulate material such as agricultural grain, its utility is not so limited. The materials that can be processed may be other than such specifically particulate material. For example, the material may be composed of solid particles suspended or carried in a liquid and forming a relatively viscous slurry with the processing efforts directed to drying of the material as well as affecting the characteristics of the solids.

It will be readily apparent that providing of a material treating apparatus of the illustrated and described construction with a control mechanism of this invention results in a highly advantageous capability of directing the airflow to selected regions of the apertured bedplate. This capability enables the operation of the apparatus to be controlled to obtain optimum performance in processing of the material that is routed through the apparatus. Utilization of a single control plate mounted for selective angular positioning in the airstream entering the heating unit is effective in obtaining the necessary degree of control in directing the airflow path to be more effective at a selected region along the longitudinal extent of the bedplate.

Having thus described this invention, what is claimed is:

1. A material treating apparatus comprising

A) an elongated treating chamber having an inlet end and a discharge end disposed in horizontally disposed relationship and a horizontally disposed bedplate over which the material is caused to traverse from said inlet end to said discharge end, said bedplate having a plurality of apertures formed therein in relatively distributed relationship over a substantial portion of its length and through which a gaseous treating fluid is passed in effecting treatment of the material, and B) gaseous treating fluid supply means coupled in fluid flow relationship with said treating chamber for generating a flow of treating fluid at a predetermined temperature and causing the gaseous fluid to flow upwardly through the apertures in said bedplate and through the bed of material passing thereover, said fluid supply means including 1) an elongated distribution chamber disposed in underlying relationship to said bedplate and extending longitudinally with respect thereto, said distribution chamber having longitudinally extending sidewalls spaced apart a distance substantially equal to the width of said bedplate, 2) airflow inducing means coupled with said distribution chamber at an end thereof adjacent the inlet end of said treating chamber for causing air to enter and flow axially into said distribution chamber at a predetermined rate of flow, 3) heating means disposed in the flowpath of air entering said distribution chamber and operative to elevate the temperature of the air entering said distribution chamber to a predetermined degree, and 4) flowpath control means disposed in the flowpath of air entering said distribution chamber for effecting control over the path of movement of air through said distribution chamber, said control means including a planar control plate extending transversely across the path of air flowing into said distribution chamber and supported for pivotal movement about a horizontal axis extending transversely to the air flowpath and adjusting means mechanically coupled with said plate and to pivot said plate to a selected angular position with respect to its pivot axis and to maintain said plate in such selected position.

2. Material treating apparatus according to claim 1 wherein said heating means includes a heating chamber and a heat generator having a heat exchanger disposed in said heating chamber and in the flowpath of the air entering said distribution chamber and an entrance duct of transverse configuration and area that is less than the longitudinal flow area of said heating chamber, said control plate being positioned in said entrance duct.

3. Material treating apparatus according to claim 2 wherein said control plate is positioned in the lower one-third of the entrance duct area.

4. Material treating apparatus according to claim 1 wherein said heating means includes a heat generator of predetermined vertical extent disposed in the flowpath of air entering said distribution chamber and said control plate is positioned in the region of air flowing to and into heat-exchanging association with said heat generator.

5. Material treating apparatus according to claim 4 wherein said control plate is positioned at a vertical elevation with respect to said heat generator to be in the lower one-third of the vertical extent of the airstream flowing past said heat generator.

6. Material treating apparatus according to claim 5 wherein said heating means includes a heating chamber within which said heat generator is disposed and having an entrance duct of rectangular cross-section having predetermined horizontal and vertical dimensions that are at least as great as the horizontal and vertical dimensions of said heat generator, said control plate being of a length to extend substantially the entire width of said entrance duct.

7. Material treating apparatus according to claim 4 wherein said control plate is of a predetermined width and is mounted for pivoting about an edge extending transversely to the flowpath of air flowing to said heat generator.

8. Material treating apparatus according to claim 7 wherein said control plate's pivoted edge is in leading relationship to the air flowing over said plate.

* * * * *